US006530374B1

(12) United States Patent
Ferraro

(10) Patent No.: US 6,530,374 B1
(45) Date of Patent: Mar. 11, 2003

(54) AIR FILTER DEVICE PROVIDED WITH GRIPPING MEANS IN THE FORM OF A MOUTHPIECE

(76) Inventor: Fausto Ferraro, Via Fedro, 4, Napoli (IT)

( * ) Notice: Subject to any disclaimer, the term of this patent is extended or adjusted under 35 U.S.C. 154(b) by 0 days.

(21) Appl. No.: 09/744,756

(22) PCT Filed: Jul. 23, 1999

(86) PCT No.: PCT/EP99/05364

§ 371 (c)(1),
(2), (4) Date: Jan. 24, 2001

(87) PCT Pub. No.: WO00/04958

PCT Pub. Date: Feb. 3, 2000

(30) Foreign Application Priority Data

Jul. 24, 1998 (IT) ..... MI98A1717

(51) Int. Cl.[7] ..... A62B 18/08

(52) U.S. Cl. ..... 128/206.29; 128/206.21; 128/206.24; 128/206.28; 128/859

(58) Field of Search ..... 128/206.29, 206.12, 128/206.19, 206.24, 206.28, 859, 861, 862, 848

(56) References Cited

U.S. PATENT DOCUMENTS

| | | | | | |
|---|---|---|---|---|---|
| 4,719,911 | A | | 1/1988 | Carrico | |
| 5,086,768 | A | * | 2/1992 | Niemeyer | 128/205.24 |
| 5,465,734 | A | * | 11/1995 | Alvarez et al. | 128/848 |
| 5,595,173 | A | * | 1/1997 | Dodd, Jr. | 128/201.13 |
| 5,720,302 | A | * | 2/1998 | Belfer | 128/848 |
| 5,810,013 | A | * | 9/1998 | Belfer | 128/848 |
| 5,921,241 | A | * | 7/1999 | Belfer | 128/848 |
| 5,983,892 | A | * | 11/1999 | Thornton | 128/201.26 |
| 6,012,455 | A | * | 1/2000 | Goldstein | 128/207.18 |

FOREIGN PATENT DOCUMENTS

| | | |
|---|---|---|
| WO | WO 94/00196 | 1/1994 |

* cited by examiner

*Primary Examiner*—Dennis Ruhl
*Assistant Examiner*—Darwin P. Erezo
(74) *Attorney, Agent, or Firm*—Herbert Dubno

(57) ABSTRACT

Air filter device comprising at least one filter element provided with means in the form of a mouthpiece allowing the user to grip and retain the device.

8 Claims, 1 Drawing Sheet

AIR FILTER DEVICE PROVIDED WITH GRIPPING MEANS IN THE FORM OF A MOUTHPIECE

CROSS REFERENCE TO RELATED APPLICATIONS

This application is the US national stage of PCT application PCT/EP99/05364 filed Jul. 23, 1999 and Italian national application MI98A1717 filed Jul. 24, 1998 under the International Convention.

FIELD OF THE INVENTION

The present invention relates to an air filter device comprising means in the form of a mouthpiece allowing the user to grip and retain the device itself.

BACKGROUND OF THE INVENTION

Owing to the continuous increase in atmospheric pollution and the particular environmental conditions of some specific manufacturing activities, the persons at risk are forced to breath through special filtering devices such as, for example, those contained in special masks.

U.S. Pat. No. 4,719,911 discloses an air filter mask provided with a mouthpiece attached to a shaft cooperating with a pair of annular retainers frictionally engaging the shaft. The mouthpiece is configured to be held between the upper lip and the upper teeth and gum of the user; this means that from one side the retaining action cannot be strong enough to assure the adhesion of the mask to the face of the user (in fact anti-suffocation means are provided), thus requiring special, very light materials that do not avoid leakage of the mask. The known mouthpiece also does not allow a quick release in the case of possible suffocation due for instance to an occlusion of the filter.

A moisture exchange material is associated with the mask of WO 94/00196.

It is also known that such masks are difficult to use because of their size and the awkward nature of the fastening devices for fixing them to the face, resulting in their being practically unusable for example in the case of cyclists and/or motorcyclists who also have to wear a protective helmet.

OBJECTS OF THE INVENTION

It is an object of the invention to provide an air filter device which is of low weight and small size and is practical and simple to fit during use and remove after use.

Another object is to provide the filter device with means for keeping it fixed to the face, which can be easily replaced in the event of breakage or the like.

SUMMARY OF THE INVENTION

These technical problems are solved according to the present invention by an air filter device which comprises means in the form of a mouthpiece enabling the device to be gripped and retained by a user.

SUMMARY OF THE INVENTION

Figure 1:
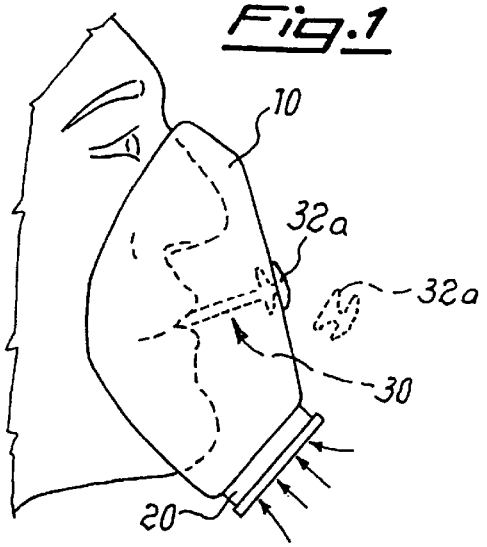
Figure 2A:
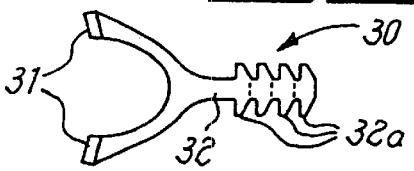
Figure 2B:
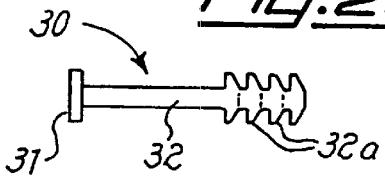

Further details may be obtained from the following description of embodiments of the invention provided with reference to the accompanying drawing in which:

FIG. 1 is an elevational view of a first embodiment of a filter device according to the invention fitted to a mask of the anti-gas type;

FIG. 2*a* is a plan view of the means for gripping and retaining the mask according to FIG. 1;

FIG. 2*b* is a side view of the gripping and retaining means according to FIG. 2*a;*

Figure 3:
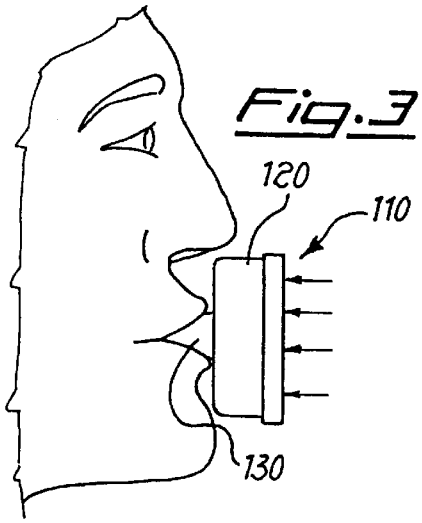
Figure 4A:
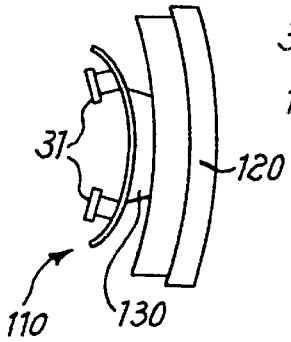
Figure 4B:
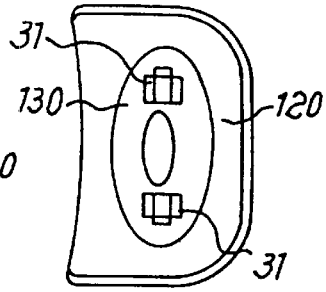

FIG. 3 is an elevational view of a second embodiment of a filter device according to the invention;

FIG. 4*a* is a plan view of the gripping means of the device according to FIG. 3;

FIG. 4*b* is a front view of the gripping and retaining means according to FIG. 4*a;*

Figure 5A:
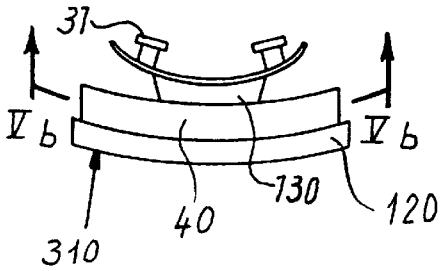
Figure 5B:
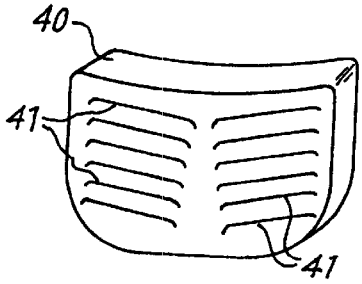

FIG. 5*a* is a plan view of an embodiment of the filter device with the arrangement, in between, of a heat and moisture exchanger; and FIG. 5*b* is a perspective view of this device seen generally along the plane indicated by Vb—Vb in FIG. 5*a.*

SPECIFIC DESCRIPTION

As shown in FIG. 1, a first embodiment of the air filter device according to the invention comprises an anti-gas mask 10 which is of a size and made of material such as to cover the nose and the mouth and adhere to the skin so as to prevent infiltration.

A filter element 20 of the conventional type and therefore not described in detail is arranged in the bottom part of the mask 10.

The mask 10 is associated with retaining means consisting of a mouthpiece 30 provided with a pair of extensions 31 allowing it to be gripped and retained by the user's teeth.

On the opposite side to the extensions 31, the mouthpiece is extended by a substantially cylindrical section 32, the free part of which terminates in a plurality of protrusions 32*a* arranged in succession adjacent to one another.

The cylindrical extension basically forms a device for adjusting the length of the mouthpiece 30 since, by introducing the end provided with protrusions into a corresponding hole in the mask, it is possible to achieve the correct adjustment in relation to individual needs; any surplus protrusions projecting outside the mask itself (FIG. 1) may be cut along any specially provided pre-weakened breakage lines.

In the case of use together with a mask, the gripping and retaining element 30 associated with the mask itself may be solid in that respiration is performed through the nose.

As illustrated in FIG. 3 the filter device 110 may also be provided without an anti-gas mask. In this case the mouthpiece 130 is directly inserted into the filter means 120 which will be provided with a special through-hole for insertion of the cylindrical section 32 with protrusions 32*a* for allowing adjustment of its length. In this case where no mask is used, the mouthpiece 130 is substantially hollow so as to allow respiration via the mouth.

Both in the version with mask and in the version without mask, it is envisaged that the filter device 310 may be associated with a heat and moisture exchanger which is known per se and therefore only schematically indicated by 40 in FIGS. 5*a,* 5*b* in which 41 also indicates the characteristic surface of the external casing similar to that of a blind. The exchange 40 is arranged between the gripping means or element 130 and the filter element.

Said exchanger 40 retains the vapor and the heat during expiration and releases said vapor and heat during inspiration, thus preventing drying of the air ducts and the formation of condensation.

I claim:

1. An air filter device comprising at least one filter element, and a mouthpiece allowing the device to be gripped and retained by the user and having a pair of gripping extensions designed to engage with the user's teeth, the mouthpiece having a further extension on which the filter element is mounted, further extension at its free end opposite to the gripping extensions provided with adjusting means for adjusting the position of the filter element on the further extension to suit the individual requirements of the user, the adjusting means comprising a plurality of protrusions which are integral with the further extension and having pre-weakened breakage lines between said protrusions facilitating removal of the protrusions beyond a respective selected pre-weakened breakage line.

2. The device according to claim 1 wherein said filter element is mounted on an anti-gas mask provided with a hole for insertion of the further extension.

3. The device according to claim 1 wherein the mouthpiece is internally solid.

4. The device according to claim 1 wherein the mouthpiece is directly connected to the filter element.

5. The device according to claim 4 wherein the mouthpiece is internally hollow.

6. The device according to claim 4, further comprising an exchanger for retaining vapor and the heat.

7. The device according to claim 6 wherein said exchanger is arranged in between the gripping extensions and the filter element.

8. The device according to claim 1 wherein connection between the filter element and the further extension is made by inserting said length into a corresponding hole of the filter element.

* * * * *